US006280146B1

(12) United States Patent
Bush et al.

(10) Patent No.: US 6,280,146 B1
(45) Date of Patent: Aug. 28, 2001

(54) SEALED COMPRESSOR USING HOT OIL TO ACTUATE PROTECTOR SWITCH

(75) Inventors: James W. Bush, Skaneateles, NY (US); Zili Sun; Carlos Zamudio, both of Arkadelphia, AK (US); Jason Hugenroth, Hope, AK (US); Greg Hahn; Thomas Barito, both of Arkadelphia, AK (US); Joe T. Hill; John R. Williams, both of Bristol, VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/512,167

(22) Filed: Feb. 24, 2000

(51) Int. Cl.[7] ..... F04B 49/10
(52) U.S. Cl. ..... 417/13
(58) Field of Search ..... 184/6.1, 6.4; 417/13

(56) References Cited

U.S. PATENT DOCUMENTS 3,010,401 * 11/1961 Granqvist ..... 417/13
3,232,519 * 2/1966 Long ..... 417/13
4,361,417 * 11/1982 Suzuki ..... 417/13
6,017,205 * 1/2000 Weatherston et al. ..... 417/13

* cited by examiner

*Primary Examiner*—Michael Koczo
(74) *Attorney, Agent, or Firm*—Carlson, Gaskey & Olds

(57) ABSTRACT

A unique protection circuit for a sealed compressor incorporates oil structure which directs a heated oil onto a motor protection circuit. The motor protection circuit is of the type which shuts down operation of an electric motor when a predetermined temperature is sensed. The motor protection circuit is positioned adjacent to an oil return path which is opened when a high temperature is experienced in the compressor pump unit. The valve in the path opens to allow flow of the returned oil onto the motor protection switch. The motor protection switch is then actuated to stop further operation of the motor. In another embodiment, the motor protection switch is immersed in the oil sump. Again, when the oil temperature increases to a predetermined amount, the motor protection switch stops further operation of the motor.

13 Claims, 2 Drawing Sheets

SEALED COMPRESSOR USING HOT OIL TO ACTUATE PROTECTOR SWITCH

BACKGROUND OF THE INVENTION

This application relates to a sealed compressor wherein hot oil is moved into contact with a protector switch to shut down the compressor motor in the event that adverse conditions are occurring in the compressor.

Sealed compressors are utilized in most refrigerant compression applications. In a typical sealed compressor, an electric motor drives a compressor pump unit to compress a refrigerant. The refrigerant passes from the compressor pump unit to downstream locations in a refrigeration cycle. There are challenges with operation of sealed compressors. In some cases, there may be a loss of refrigerant within the system. This so-called loss of charge operation can have detrimental effects on the compressor pump unit. When there is an unusually low amount of refrigerant being compressed, the compressor pump components may become hot. This is undesirable.

One popular type of modern compressor pump unit is a scroll compressor pump unit. In a scroll compressor pump unit, a first scroll member has a base and a generally spiral wrap extending from the base. A second scroll member has a base and a generally spiral wrap extending from its base. The wraps of the two scroll members interfit to define compression chambers. The second scroll member is caused to orbit relative to the first, and as the two orbit, compression chambers between the two wraps decrease in volume to compress an entrapped refrigerant.

Scroll compressors are often powered by a three phase electric motor. Three phase electric motors receive three power connections to drive the motor. Occasionally, when the motor is being connected to its power supply, the phase of the three connections are improperly aligned. When this occurs, the motor may be driven in a reverse direction than that which is expected. When a scroll compressor is driven to rotate in the reverse direction, then the refrigerant which Has typically been moved from a radially outer area towards a central area moves in the opposed direction. This is undesirable, and causes the generation of a good deal of heat within the compressor pump unit.

Various methods for identifying reverse rotation and loss of charge situations in sealed compressors have been proposed. However, it would be desirable to provide a simple and yet sure method for identifying such adverse conditions, and stopping operation of a motor when such adverse conditions are identified.

SUMMARY OF THE INVENTION

In a disclosed embodiment of this invention, a protector switch for controlling a motor associated with a sealed compressor stops operation of the motor should a predetermined temperature be exceeded. The present invention places a flow of lubricating oil such that it will contact the protector switch, at least when certain adverse conditions are encountered in the compressor. Typically, known sealed compressors have a protector switch at the top of the motor stator windings. Known protector switches actuate when a particular temperature is experienced and stop operation of the motor.

However, the protector switches are mounted on the motor, and are thus not always sensitive to increased temperature in the pump unit. In one disclosed embodiment of this invention, a heat sensitive valve opens when a particular temperature is achieved in the compressor pump unit. When opened, this valve allows flow of oil from the compressor pump unit to a path directed to flow onto the protector switch. The valve is preferably a bi-metal temperature sensitive valve. When the compressor pump unit reaches an unusually high temperature due to some adverse condition such as loss of charge or reverse running, the valve opens. Hot oil from the compressor pump unit is then directed into contact with the protector switch. This will cause the protector switch to be actuated, stopping operation of the motor.

In a second embodiment, the protector switch is positioned at a lower end of the windings such that it is in contact with the oil sump. During adverse operation of the compressor, the temperature of the oil in the sump will increase. The protector switch will then stop operation of the motor when this increasing oil temperature reaches a predetermined limit.

The present invention thus provides a simple and sure way of identifying adverse conditions during operation of a sealed compressor. These and other features of the present invention can be best understood from the following specification and drawings.

DETAILED DESCRIPTION OF A PREFERRED EMBODIMENT

Figure 1:
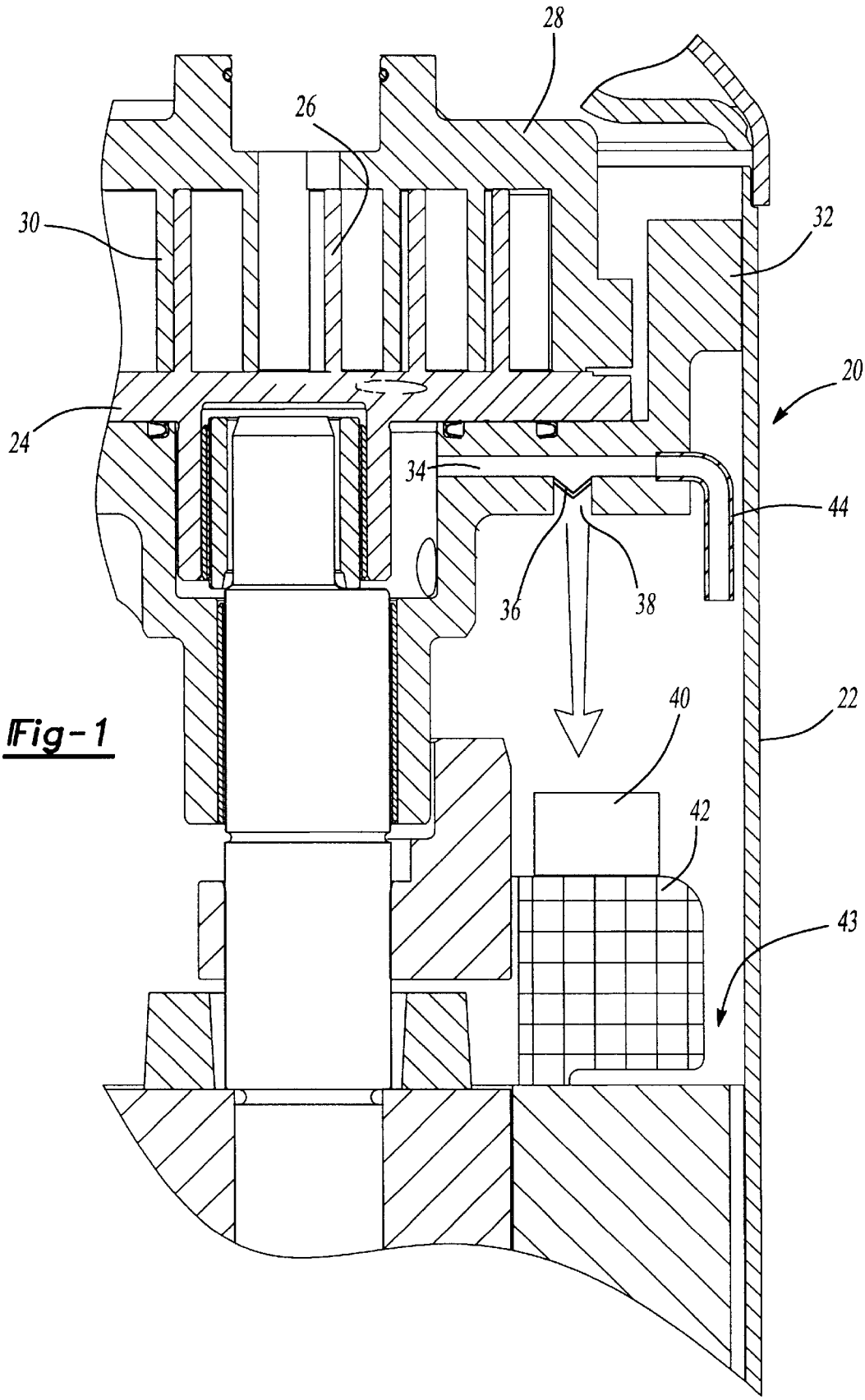
FIG. 1 shows a first embodiment of the present invention.

FIG. 1 shows a sealed compressor 20 incorporating an outer housing 22 enclosing a compressor pump unit. The compressor is illustrated as a scroll compressor having an orbiting scroll 24 with a wrap 26 interfitting with a non-orbiting scroll 28 having a wrap 30. Although a scroll compressor is illustrated, it should be understood that aspects of this invention would extend to other types of sealed compressors.

A crankcase 32 supports the orbiting scroll 24 within the sealed compressor 20. The crankcase 32 is shown having an oil return path 34 for returning oil from a position between the orbiting scroll 24 and the crankcase 32. A selectively opened valve 36 blocks flow of oil through a path that extends downwardly through the crankcase and communicates with the path 34. Path 38 is positioned to be above a motor protector switch 40, which is associated with the motor windings 42 of the electric motor 43 for the sealed compressor 20. The protector switch 40 may be as known, and operates to shut down the motor 43 if an excessive temperature is sensed at the protector switch 40. When the valve 36 is closed, oil flows from path 34 to an oil return tube 44, such that it is not directed at the protector switch 40.

In the event that an adverse condition exists within the sealed compressor, such as powered reverse rotation due to a faulty connection of the power supply, a low charge operation, or some other adverse condition, then the temperature of the compressor pump unit will become elevated. The oil contacting the compressor pump structure will also become unusually hot. The valve 36 is preferably operable to move between an open and close position dependent upon a sensed heat. Thus, if the temperature of the oil contacting the valve 36 exceeds a predetermined maximum, the valve 36 moves to an open position. Such heat sensitive valves are known, and may be provided by valves typically known as "bi-metal valves."

Such valves can be designed to open at a predetermined temperature. When the oil reaches a predetermined temperature, and the valve 36 opens, the oil is allowed to flow from path 34, and into the path 38. The oil returning through path 38 will contact switch 40. This heated oil will trip the switch 40, stopping operation of the motor 43.

In this way, a relatively simple system is utilized in conjunction with existing control technology to provide shutdown in the event of adverse conditions.

Figure 2:
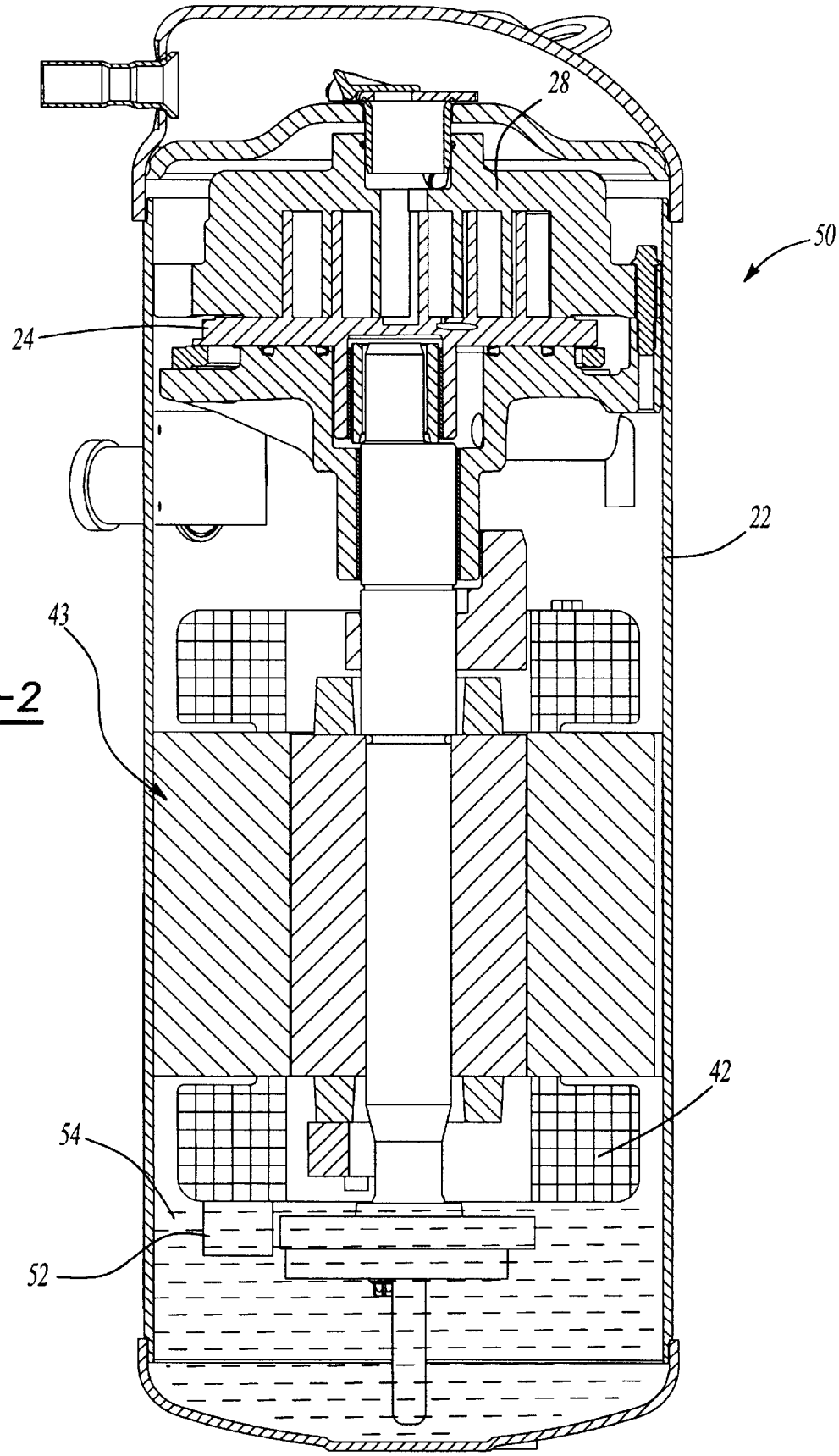
FIG. 2 shows a second embodiment of the present invention.

FIG. 2 shows a second embodiment 50 wherein the protector switch 52 is mounted at the bottom end of the stator windings 42 of the motor 43. The protector switch 52 is now beneath the level 54 of oil in the sump of the sealed compressor. Thus, during operation under adverse conditions, the oil in the sump 54 will increase in temperature. This will trip switch 52, allowing it to shut down the motor 43. As should be appreciated by those in the art, the motor switch 52 in the embodiment of FIG. 2 might need to be more sensitive than the switch 40 as shown in the FIG. 1 embodiment. That is, the oil leaving the path 38 will be more directly heated to an elevated temperature than the oil in the sump 54 might be. Thus, the protector switch 52 might be necessarily actuated at a lower temperature than the switch 40 in the FIG. 1 embodiment. However, both systems provide very simple protection circuits.

The switches 40 as illustrated in this application are shown somewhat schematically. In practice, the switches are often housed in a protective or electrically insulated coating or housing. The term "protector switch" as used in this application would include not only the switch components, but also their associated coatings or housing.

Although preferred embodiments of this invention have been disclosed, a worker in this art would recognize that certain modifications would come within the scope of this invention. For that reason, the following claims should be studied to determine the true scope and content of this invention.

What is claimed is:

1. A sealed scaled compressor comprising:

an electric motor;

a compressor pump unit including a first and second scroll member, with said first and second scroll members each including a base and a generally spiral wrap extending from said base, and said second scroll member being driven by said electric motor, said electric motor including a stator having windings at each of two opposed ends;

a protector switch for stopping operation of said motor and said compressor pump unit when a predetermined temperature is reached; and said protector switch being positioned such that heated oil from said compressor pump unit will contact said protector switch at least when elevated temperatures are experienced in said compressor pump unit, said protector switch being positioned at an end of one of said stator windings.

2. A sealed compressor as recited in claim 1, wherein said protector switch is positioned at an end of said stator winding of said electric motor adjacent said compressor pump unit.

3. A sealed compressor as recited in claim 1, wherein said protector switch is positioned to be immersed in an oil sump nadjacent a vertically lower portion of said sealed housing.

4. A sealed compressor as recited in claim 3, wherein said protector switch acts to stop operation of said motor, and said protector switch being mounted on an end of a stator winding for said motor.

5. A sealed compressor comprising:

an electric motor;

a compressor pump unit to be driven by said electric motor;

a protector switch for stopping operation of said motor and said compressor pump unit when a predetermined temperature is reached;

said protector switch being positioned such that heated oil from said compressor pump unit will contact said protector switch at least when elevated temperatures are experienced in said compressor pump unit; and a valve opens when a predetermined temperature is reached and allows oil to flow onto said protector switch.

6. A sealed compressor as recited in claim 5, wherein said valve is positioned in a return path, and said path is positioned to direct heated oil onto said protector switch.

7. A sealed compressor as recited in claim 5, wherein said compressor pump unit includes a first and second scroll member, with said first and second scroll members each including a base and a generally spiral wrap extending from said base.

8. A scroll compressor comprising:

a first scroll member having a base and a generally spiral wrap extending from said base;

a second scroll member having a base and generally spiral wrap extending from said base, some wraps of said first and second scroll members interfitting to define compression chambers;

a crankcase for supporting said second scroll member, said second scroll member being driven by a shaft to orbit relative to said first scroll member, and an electric motor driving said shaft; and a motor protector switch associated with said electric motor and mounted on a stator of said electric motor, said protector switch stopping operation of said motor when said protector switch senses a predetermined temperature, and said protector switch being positioned to be contacted by oil when an adverse condition is experienced in said compressor.

9. A scroll compressor as recited in claim 1, wherein a valve opens when a predetermined temperature is reached and allows oil to flow onto said protector switch.

10. A scroll compressor as recited in claim 9, wherein said valve is positioned in a return path, and said path is positioned to direct heated oil onto said protector switch.

11. A compressor as recited in claim 8, wherein said protector switch is positioned at an end of a stator winding of said electric motor adjacent said compressor pump unit.

12. A scroll compressor as recited in claim 8, wherein said protector switch is positioned to be immersed in an oil sump adjacent a vertically lower portion of said sealed housing.

13. A scroll compressor as recited in claim 12, wherein said protector switch acts to stop operation of said motor, and said protector switch being mounted on an end of a stator winding for said electric motor.

* * * * *